US006551655B2

(12) United States Patent
White et al.

(10) Patent No.: US 6,551,655 B2
(45) Date of Patent: Apr. 22, 2003

(54) SYSTEMS, METHODS, AND APPARATUSES FOR APPLICATION OF LIQUID ADDITIVES TO MATERIALS

(75) Inventors: Junius W. White, Hobbsville, NC (US); Stanley A. Brantley, Jr., Ivor, VA (US)

(73) Assignee: Amadas Industries, Inc., Suffolk, VA (US)

( * ) Notice: Subject to any disclaimer, the term of this patent is extended or adjusted under 35 U.S.C. 154(b) by 33 days.

(21) Appl. No.: 09/798,725

(22) Filed: Mar. 2, 2001

(65) Prior Publication Data

US 2002/0122350 A1 Sep. 5, 2002

(51) Int. Cl.[7] ..... B05D 7/00; B05D 7/06; B01F 7/12; B01F 15/02

(52) U.S. Cl. ..... 427/212; 118/303; 366/172.1; 366/293; 366/317; 366/325.2; 366/326.1; 366/348

(58) Field of Search ..... 118/303, 314; 427/212; 366/97, 172.1, 293, 297, 298, 315, 317, 325.2, 326.1, 348; 425/201, 203, 204, 205

(56) References Cited

U.S. PATENT DOCUMENTS

| | | | | |
|---|---|---|---|---|
| 1,430,070 A | | 9/1922 | Franzwa | |
| 1,974,611 A | | 9/1934 | Gundelfinger | |
| 4,797,080 A | * | 1/1989 | Wanninger | 425/204 |
| 4,932,156 A | | 6/1990 | Underwood | |
| 5,158,725 A | * | 10/1992 | Handa et al. | 425/204 |
| 5,192,587 A | | 3/1993 | Rondy | |
| 5,301,460 A | | 4/1994 | Corbitt | |
| 5,308,653 A | | 5/1994 | Rondy | |
| 5,358,738 A | | 10/1994 | Sawka | |
| 5,562,956 A | | 10/1996 | White, Jr. | |
| 5,866,201 A | | 2/1999 | Blue | |
| 6,162,496 A | | 12/2000 | Blue | |

* cited by examiner

*Primary Examiner*—Joseph W. Drodge
(74) *Attorney, Agent, or Firm*—Kaufman & Canoles

(57) ABSTRACT

This invention provides a mixing chamber that utilizes several tined cylinders to convey materials through the mixing chamber for applying liquid additives to the materials. Each of the tined cylinders includes a number of spring biased tines extending from the surface of the cylinder. The tined cylinders are arranged within the mixing chamber such that, as the tined cylinders rotate about an axis, the spring biased tines engage the materials within the mixing chamber and "sweep" them along towards a discharge opening of the mixing chamber. As the materials are conveyed through the mixing chamber, an additive liquid, typically containing various chemicals, colorants, dies, and/or paints, is sprayed onto the materials. In this manner, liquid additives are applied to materials more evenly and more thoroughly, resulting in a more consistent finished product.

42 Claims, 6 Drawing Sheets

SYSTEMS, METHODS, AND APPARATUSES FOR APPLICATION OF LIQUID ADDITIVES TO MATERIALS

BACKGROUND OF THE INVENTION

1. Field of Invention

This invention relates to the application of liquid additives to materials.

2. Description of Related Art

Generally, it is known to chip, chop, cut, or grind various woods and/or herbaceous materials into small pieces, generally referred to as "wood chips". These wood chips are often used as a decorative bedding material around shrubbery, trees, and other plants to enhance the appearance of yards and gardens. In addition to their esthetic qualities, wood chips can also be used as a ground cover to limit the growth of unwanted plants and weeds and help retain moisture within the ground.

However, exposure to the ultraviolet ray of the sun and the natural process of decay quickly turns natural wood chips to a dull and unattractive, gray color. Furthermore, untreated wood chips generally tend to rot quickly, particularly in areas with a high moisture concentration.

Therefore, it is generally known to treat wood chips with various chemicals, colorants, dies, and/or paints to ensure that the wood chips maintain a desired color and resist rotting.

One of the known methods for applying chemicals, colorants, dies, and/or paints to wood chips involves the application of a liquid, such as, for example, a liquid colorant, to wood chips as the wood chips travel within an auger-screw conveyor. The auger-screw conveyors typically comprise one or two elongated screw(s) that are contained within a cylindrical or trough-like housing. These auger-screw conveyors are similar to those commonly used in industry and on farms for moving relatively fine particulate materials, such as, for example grains, along horizontal or upwardly angled paths.

The liquid colorant is generally applied to the wood chips by one of two methods. The first method involves immersing the wood chips in a pool of the liquid colorant and then allowing the wood chips to be drawn out of the colorant pool and moved to another location by the auger-screw conveyor. The second method involves the positioning of spray nozzles within the auger-screw conveyor such that, as the wood chips travel along the conveyor, the liquid colorant is sprayed onto the wood chips.

In both methods, it is important to allow the wood chips to be sufficiently coated with the liquid colorant and substantially dried before they are discharged from the auger-screw conveyor.

Because the various chemicals, colorants, dies, and/or paints that are applied to the wood chips are relatively expensive, the primary goal of these known methods is to allow a sufficient amount of liquid to saturate the wood chips so that a desired color and/or preservative quality is achieved without allowing excess liquid to be used during the process. For example, any amount of liquid that is used, which exceeds the amount necessary to color and/or chemically treat each wood chip, is an amount of liquid that is wasted.

SUMMARY OF THE INVENTION

Unfortunately, known methods fail to apply a uniform coating of liquid additives, such as, for example, chemicals, colorants, dies, and/or paints, to wood chips. In any given batch of treated wood chips, some of the wood chips are overly saturated with the liquid solution while other of the wood chips have surfaces that are not completely covered with colorant or treated sufficiently to provide adequate preservation of the wood chips.

Additionally, the use of known auger-screw conveyors to mix the additives into the wood chips is relatively inefficient. For example, the wood chips are typically fed into the auger-screw conveyors by means of a hopper structure mounted directly above the auger-screw conveyor. This method has several drawbacks. First, the size and speed of the auger-screw conveyor requires a relatively high amount of horsepower in order to function, thus resulting in elevated operational costs.

Second, batches of pre-processed wood chips often include varying size particles, larger than normal particles, stringing material, or foreign objects, which can cause the auger-screw conveyor to jam or stall. Each time the auger-screw conveyor jams or stalls, valuable production time is lost until the auger-screw conveyor can be cleared. Clearing an auger-screw conveyor is usually a manual process, which is dangerous and labor intensive.

Third, since auger-screw conveyors operate at low rotational speeds, they do not provide much agitation for the wood chip and additive mixture. Thus, in order to provide a consistent finished product, the wood chips must be immersed in the additive over a relatively long length of the auger-screw conveyor. This, in turn, adds time to the known processes of applying the additive to the wood chips and ultimately reduces productivity levels. Furthermore, auger-screw conveyors require the use of large volumes of additive to ensure the proper coverage. This leads to higher costs and longer drying times and or higher transportation cost due to the weight of an overly saturated finished product.

Fourth, auger-screw conveyors tend to tear or break down the wood chips as they are conveyed. This creates "fines" or undersized particles that are not desired in the finished product. When adding liquid additives these "fines" are very absorbent and increase the amount of additive needed for the finished product.

Last, when the auger-screw conveyor is fed by a fixed hopper above the conveyor, the wood chips tend to "bridge" or become non-flowing. This, like the presence of varying size particles, can cause the auger-screw conveyor to jam or stall, requiring that the auger-screw conveyor be stopped and manually cleared. Additionally, "bridging" can cause the auger-screw conveyor to be fed in an erratic manner, which creates a finished product that is not uniformly coated.

Accordingly, this invention provides systems, methods and apparatuses, which apply additives to a materials, such as, for example, wood chips, more evenly and more thoroughly mix the materials to ensure a consistent finished product.

In accordance with the apparatuses, systems and methods of this invention, one exemplary embodiment of the system for applying liquid additives to materials, such as, for example wood chips, uses a mixing chamber for applying the liquid additives to the materials. Unlike prior mixing chambers, the mixing chamber of this invention does not include an auger-screw conveyor, which suffers from at least the problems described above. Instead, the mixing chamber of this invention utilizes several tined cylinders to convey the wood chips through the mixing chamber.

Each of the tined cylinders includes a number of spring biased tines extending from the surface of the cylinder. The tined cylinders are arranged within the mixing chamber such that, as the tined cylinders rotate about an axis, the spring biased tines engage wood chips (which have been input into the mixing chamber via a mixing chamber input opening) within the mixing chamber and "sweep" the wood chips along towards a discharge opening of the mixing chamber.

The tined cylinders are further arranged within the mixing chamber such that, as the wood chips are swept along by, for example, a first rotating tined cylinder, the wood chips are sequentially engaged and swept along by successive rotating tined cylinders until the wood chips are discharged from the discharge opening of the mixing chamber.

The use of spring biased tines provide a flexible method of propelling wood chips through the mixing chamber. Thus, materials can be conveyed through the mixing chamber without being crushed, ground, or damaged.

As the wood chips are conveyed through the mixing chamber, an additive liquid, typically containing various chemicals, colorants, dies, and/or paints, is sprayed onto the wood chips.

In various exemplary embodiments of this invention, the system for applying liquid additives to materials includes an infeed hopper. Unlike most known systems, the infeed hopper of this invention is an independent portion of the system.

During operation, the infeed hopper supplies wood chips to the mixing chamber. An adjustable flow control gate is located at a discharge end of the infeed hopper. The adjustable flow gate is used to control the amount of wood chips that leave the infeed hopper. Thus, a uniform flow of wood chips is maintained to the mixing chamber.

In other exemplary embodiments, the system for applying liquid additives to materials includes a discharge conveyor. The discharge conveyor is positioned adjacent or below the mixing chamber discharge opening such that treated wood chips being discharged from the mixing chamber can be transported to a specific location, and, for example, formed into a pile.

Accordingly, this invention separately provides systems, methods, and apparatuses that can process batches of wood chips that include varying size particles, larger than normal particles, stringing material, or foreign objects, without jamming or stalling.

This invention separately provides systems, methods, and apparatuses that more thoroughly mix the product to ensure a consistently coated finished product.

This invention separately provides systems, methods, and apparatuses that reduce the amount of time required to apply an additive to the wood chips and ultimately increases productivity levels.

This invention separately provides systems, methods, and apparatuses that provide a spring-tooth cylinder for improved mixing of the wood chips and the additive.

This invention separately provides systems, methods, and apparatuses that provide improved agitation for the wood chip and additive mixture.

This invention separately provides systems, methods, and apparatuses that creating less "fines" or undersized particles.

This invention separately provides systems, methods, and apparatuses that reduce the tendency of wood chips to "bridge" or become non-flowing during the additive application process.

This invention separately provides systems, methods, and apparatuses that reduce the tendency of wood chips to be fed in an erratic manner.

This invention separately provides systems, methods, and apparatuses that require a reduced volume of additive to ensure the proper coverage of additive on the wood chips.

This invention separately provides systems, methods, and apparatuses that consume less additives in order to create a finished product.

This invention separately provides systems, methods, and apparatuses that apply additives to the surfaces of wood chips, without thoroughly soaking or overly saturating the wood chips so as to reduce the amount of additive required and reduce the expense of treated wood chips.

This invention separately provides systems, methods, and apparatuses that reduce the treated wood chip drying times.

This invention separately provides systems, methods, and apparatuses that reduce transportation costs of the treated wood chips due to the reduced weight of the properly saturated finished product.

This invention separately provides systems, methods, and apparatuses that provide an independent, variable speed, infeed hopper.

This invention separately provides systems, methods, and apparatuses that provide uniform, metered flow of materials into the mixing chamber.

This invention separately provides systems, methods, and apparatuses that include a backwall extension for containing overspills.

This invention separately provides systems, methods, and apparatuses that require a reduced amount of horsepower in order to function, thus resulting in reduced operational costs.

This invention separately provides systems, methods, and apparatuses that are less dangerous and labor intensive to operate.

These and other features and advantages of this invention are described in or are apparent from the following detailed description of various exemplary embodiments of the apparatuses, systems, and methods of this invention.

BRIEF DESCRIPTION OF THE DRAWINGS

Exemplary embodiments of the systems and methods according to this invention will be described in detail, with reference to the following figures, wherein like reference numerals refer to like elements throughout the several views, and wherein.

DETAILED DESCRIPTION OF PREFERRED EMBODIMENTS

For simplicity and clarification, the operating principles, design factors, and layout of the apparatuses, systems, and methods for applying liquid additives to materials according to this invention are explained with reference to various exemplary embodiments of the apparatuses, systems, and methods for applying liquid additives to materials according to this invention. The basic explanation of the operation of the apparatuses, systems, and methods for applying liquid additives to materials is applicable for the understanding and design of the constituent components employed in the apparatuses, systems, and methods for applying liquid additives to materials of this invention.

Furthermore, for simplicity and clarification, the embodiments of this invention will be described with reference to the application of liquid additives to wood chips. However, it should be appreciated that the terms "wood chip" and "wood chips" are for a basic explanation and understanding of certain of the constituent components of the apparatuses, systems, and methods for applying liquid additives to materials of this invention. Therefore, the terms "wood chip" and/or "wood chips" are not to be construed as limiting this invention, but should be understood to allow additional or alternative materials, such as, for example, rubber, plastic, composite, or other materials that have been reduced to appropriately sized particles, to be coated with additives using the apparatuses, systems, and methods for applying liquid additives to materials of this invention.

Figure 1:
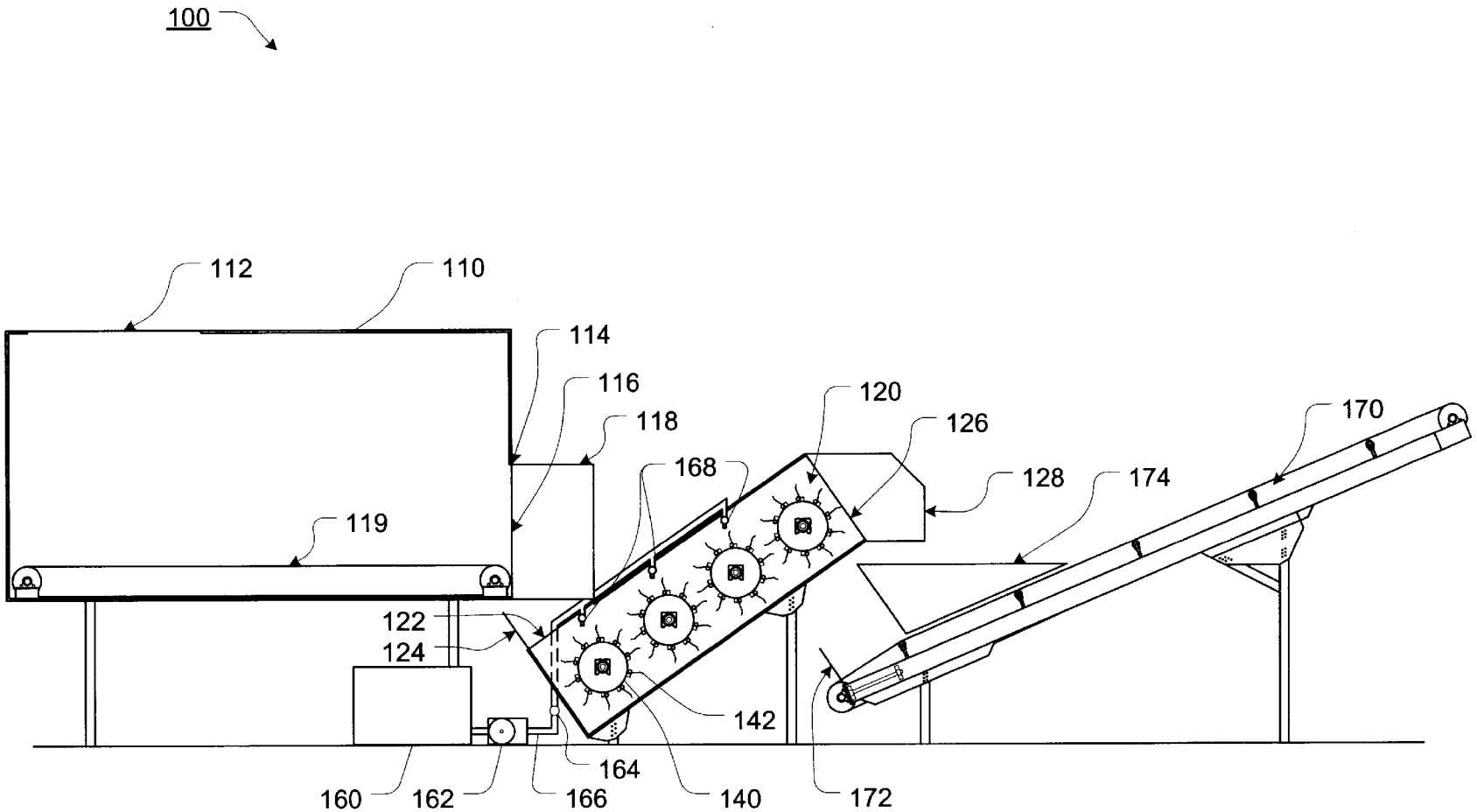
FIG. 1 shows a functional block diagram outlining a first exemplary embodiment of a system for applying liquid additives to materials according to this invention.

FIG. 1 shows a functional block diagram outlining a first exemplary embodiment of a system for applying liquid additives to materials according to this invention. As illustrated in FIG. 1, the first exemplary embodiment of the system for applying liquid additives to materials 100 includes an infeed hopper 110 and a mixing chamber 120.

The infeed hopper 110 includes at least some of an infeed hopper input opening 112, an adjustable flow control gate 114, an infeed hopper discharge opening 116, and an infeed hopper discharge extension 118. In various exemplary embodiments, the infeed hopper 110 is constructed of one quarter inch steel plate.

Figure 2:
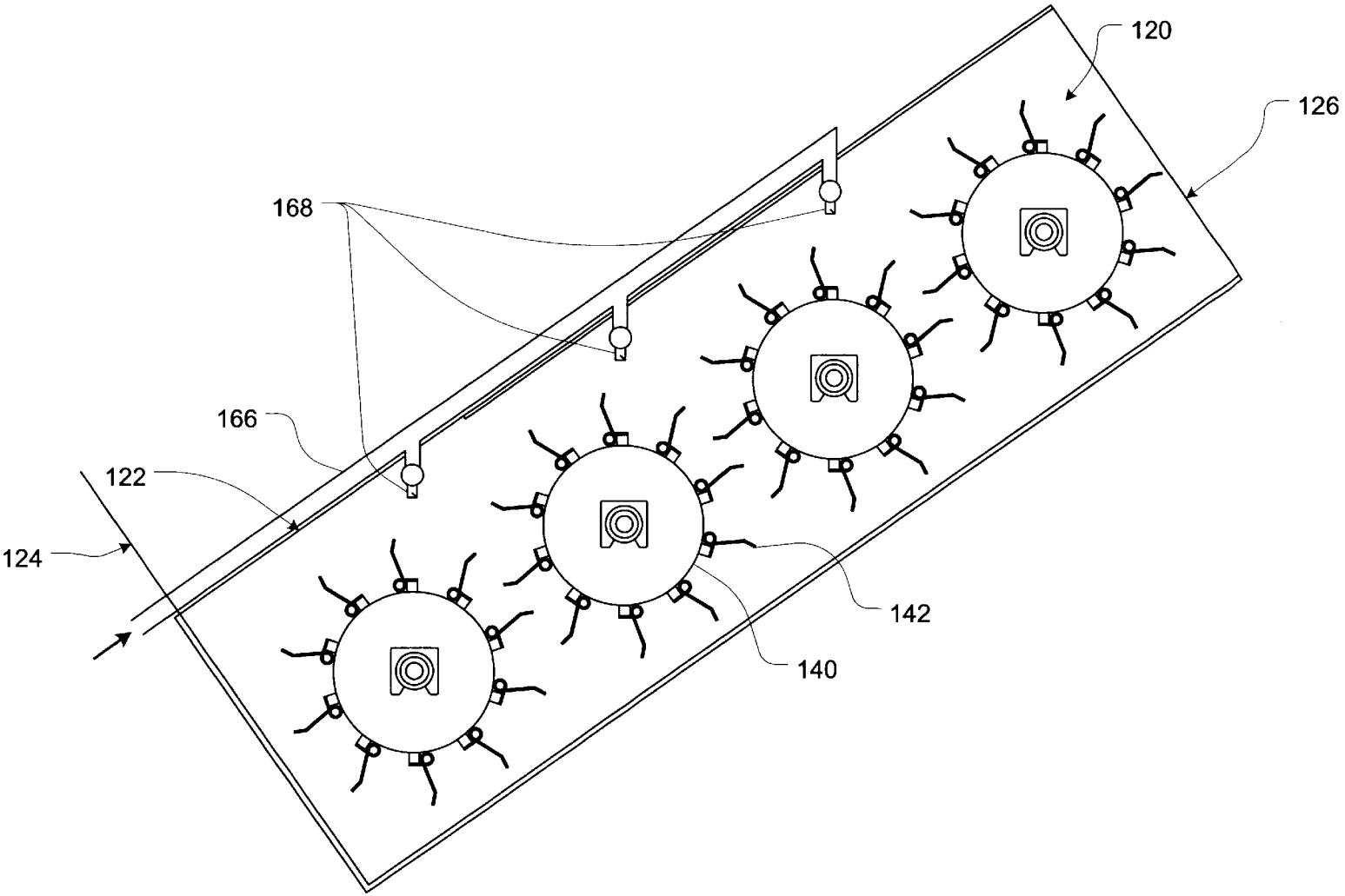
FIG. 2 shows a functional block diagram outlining a first exemplary embodiment of a liquid additive/materials mixing chamber according to this invention.
Figure 4:
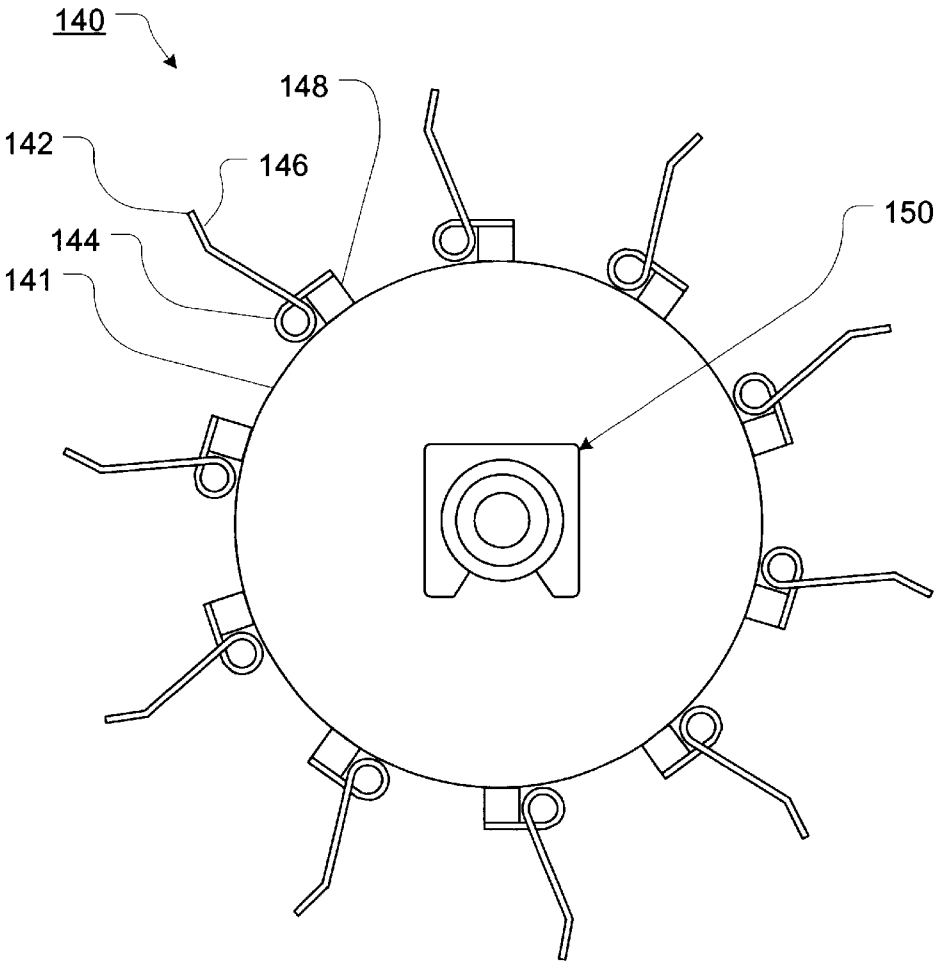
FIG. 4 shows a side view of an exemplary embodiment of a tined cylinder according to this invention.

The mixing chamber 120, as further shown in FIG. 2, includes at least some of a mixing chamber input opening 122, a mixing chamber backwall extension 124, a mixing chamber discharge opening 126, and a mixing chamber discharge opening extension 128. The mixing chamber 120 also includes several tined cylinders 140 (as shown in FIG. 4), rotatably attached, via an attachment 150, within the mixing chamber 120. Each of the tined cylinders 140 includes a plurality of individual tines 142. In various exemplary embodiments, each tined cylinder 140 is rotated by a high efficiency motor (not shown) coupled by belt to a helical gear box (not shown).

Each tine 142 is permanently or removably attached to the surface of at least one cylindrical disk 141 via a tine support 148. In various exemplary embodiments, each tine 142 is constructed of spring steel wire. Each tine 142 extends from a tine support 148 and bends, to form an end portion 146. The tine end portion 146 allows each tine to efficiently agitate, mix, and tumble wood chips within the mixing chamber.

Figure 5:
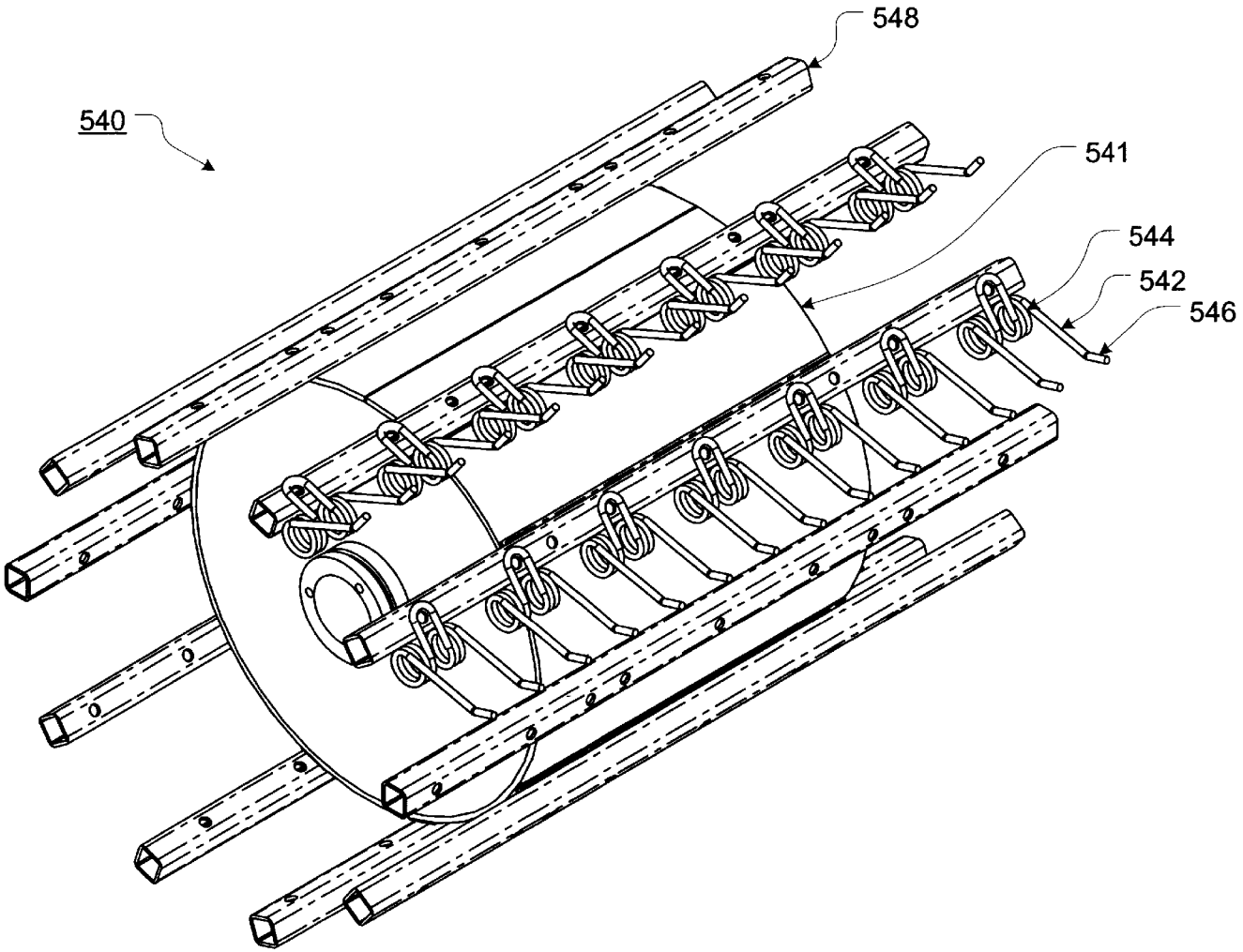
FIG. 5 shows a perspective view of a first exemplary embodiment of a tined cylinder according to this invention.
Figure 6:
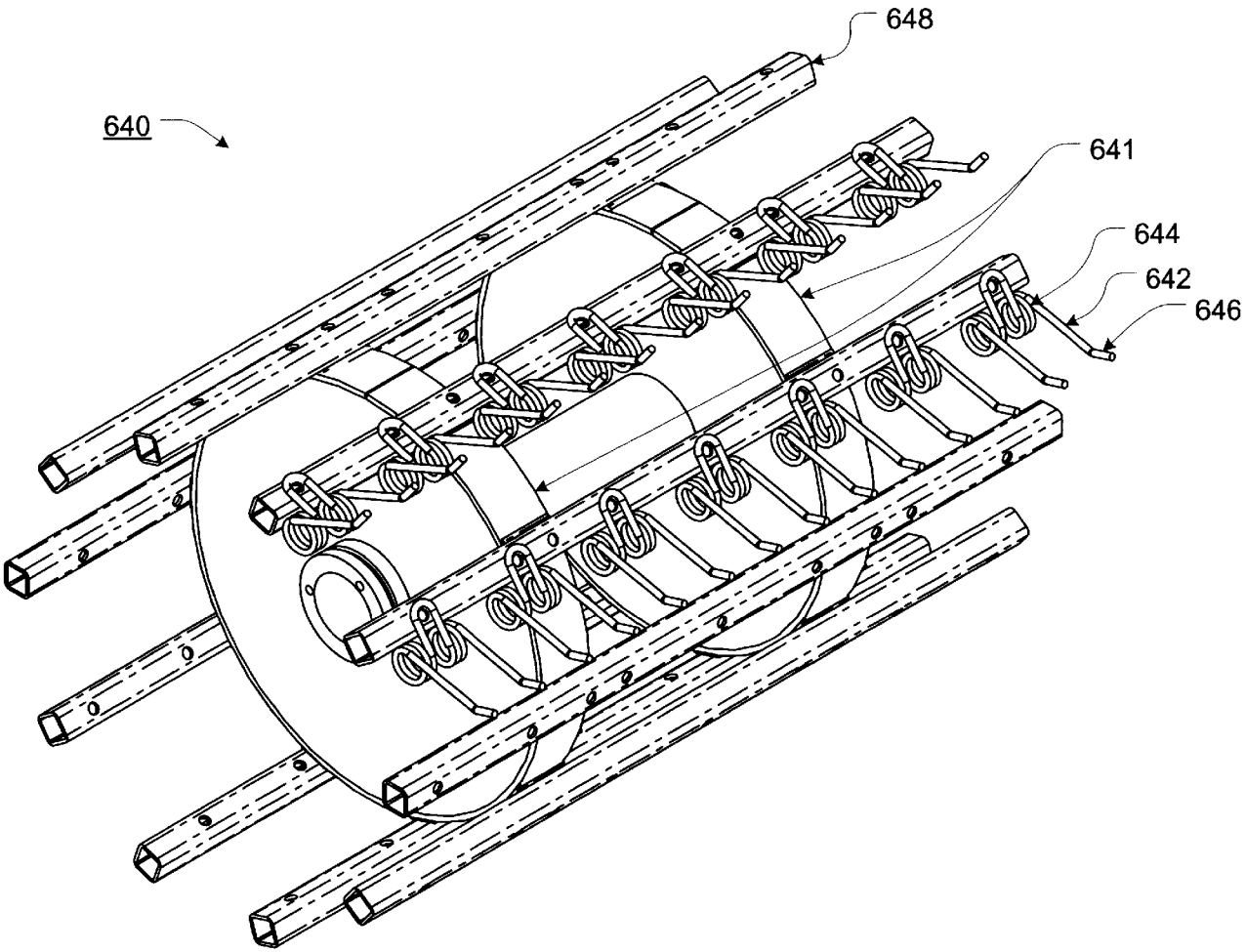
FIG. 6 shows a perspective view of a second exemplary embodiment of a tined cylinder according to this invention.

In various exemplary embodiments, each tine 142 includes two end portions 146, as shown in FIGS. 5 and 6.

Each tine 142 also includes a tine biasing portion 144. In various exemplary embodiments, the tine biasing portion 144 is a circular bend in the tine 142 that allows the tine 142 to flex a predetermined amount in order to allow the wood chips to be swept through the mixing chamber without being broken.

The mixing chamber 120 also includes at least one spray nozzle 168. In various exemplary embodiments, the mixing chamber 120 includes a plurality of spray nozzle 168. Each spray nozzle 168 is connected, via an additive supply line 166, to an additive mixing/holding tank 160. A pump 162 and a volume regulator 164 are disposed within the additive supply line 166 to control the volume at which a liquid additive is sprayed from the nozzles 168 and maintain an accurate flow rate of the liquid additive.

In various exemplary embodiments, the system for applying liquid additives to materials 100 further includes a discharge conveyor 170.

During operation of the system for applying liquid additives to materials 100, wood chips are loaded into the infeed hopper 110 via the infeed hopper input opening 112. The wood chips are then conveyed through the infeed hopper discharge opening 116 via the adjustable flow control gate 114. In various exemplary embodiments, the wood chips are conveyed via a drag chain 119 located on a floor of the infeed hopper 110. In various exemplary embodiments, the drag chain is constructed of a hardened chain and is driven by a high efficiency motor coupled to a shaft mounted helical gear reducer (not shown). It should be appreciated that multiple drag chains may be included in the floor of the infeed hopper 110 to convey the wood chips. By controlling the speed of the drag chain 119 and the adjustable flow control gate 114, an operator can control the flow rate of wood chips through the system 100.

The adjustable flow control gate 114 is used to control the amount of wood chips that are discharged from the infeed hopper 110 and to provide a uniform flow of wood chips into the mixing chamber 120. In various exemplary embodiments, the infeed hopper discharge extensions 118 help to guide the wood chips into the mixing chamber 120. However, it should be appreciated that the system 100 can be operated without the infeed hopper discharge extensions 118.

As the wood chips are discharged from the infeed hopper 110, gravity and inertia cause the wood chips to fall into the mixing chamber input opening 122. In various exemplary embodiments, the mixing chamber 120 is arranged at an upwardly inclined angle relative to the ground. However, the mixing chamber 120 may also be arranged such that the mixing chamber 120 is parallel to the ground. In various exemplary embodiments, the mixing chamber 120 includes a mixing chamber backwall extension 124 that aids in the loading of the wood chips into the mixing chamber 120. However, it should be appreciated that the mixing chamber 120 can be operated without the mixing chamber backwall extension 124.

As the wood chips are fed into the mixing chamber 120, each tined cylinder 140 is rotated in a counter clockwise direction. In this manner, the tines 142 sweep the wood chips toward the mixing chamber discharge opening 126. In various exemplary embodiments, each tined cylinder 140 is rotated at a different rotational speed.

As the tined cylinders 140 are rotated and the wood chips are conveyed from the mixing chamber input opening 122 toward the mixing chamber discharge opening 126, a liquid additive such as, for example, a chemical, colorant, dye, and/or paint, is pumped, via the pump 162, from an additive mixing/holding tank 160. The pump 162 draws the liquid additive from the additive mixing/holding tank 160 through the additive supply line 166 and forces the liquid additive through the additive supply line 166 and the spray nozzles 168 into the mixing chamber 120. The volume regulator 164, disposed within the additive supply line 166, controls the volume at which a liquid additive is sprayed from the nozzles 168 and maintains an accurate flow rate of the liquid additive.

In various exemplary embodiments, the volume regulator 164 regulates the volume at which the liquid additive is sprayed from the nozzles 168. It should be appreciated that the particular volume and/or pressure at which the liquid additive is sprayed from the nozzles 168 is dependent upon such factors as the viscosity of the liquid additive, the types of nozzles used, the volume of wood chips to which the liquid additive is to be applied, and the desired amount of liquid additive to be applied to the wood chips.

As the wood chips are discharged from the mixing chamber discharge opening 126, gravity and inertia cause the treated wood chips to fall on the optional discharge conveyor 170. In various exemplary embodiments, the discharge conveyor 170 is a free standing 36" belt conveyor, constructed of 6" ship channel iron, and powered by a motor (not shown) coupled by belt to a shaft mounted helical gear box (not shown). It should be appreciated that the discharge conveyor 170 can be placed at any degree of inclination or declination as desired.

The discharge conveyor 170 optionally includes a discharge conveyor backwall extension 172 that is positioned at the rear of the discharge conveyor 170 to aid in the placement of the treated wood chips on the discharge conveyor 170. Additionally, the discharge conveyor 170 optionally includes discharge conveyor input extensions 174 that are positioned along either side of the discharge conveyor 170 for further aiding in the efficient placement of the wood chips on the discharge conveyor 170. It should be appreciated that, as with the infeed hopper discharge extensions 118 and the mixing chamber backwall extension 124, the discharge conveyor 170 can be operated without the discharge conveyor backwall extension 172 or the discharge conveyor input extensions 174.

Figure 3:
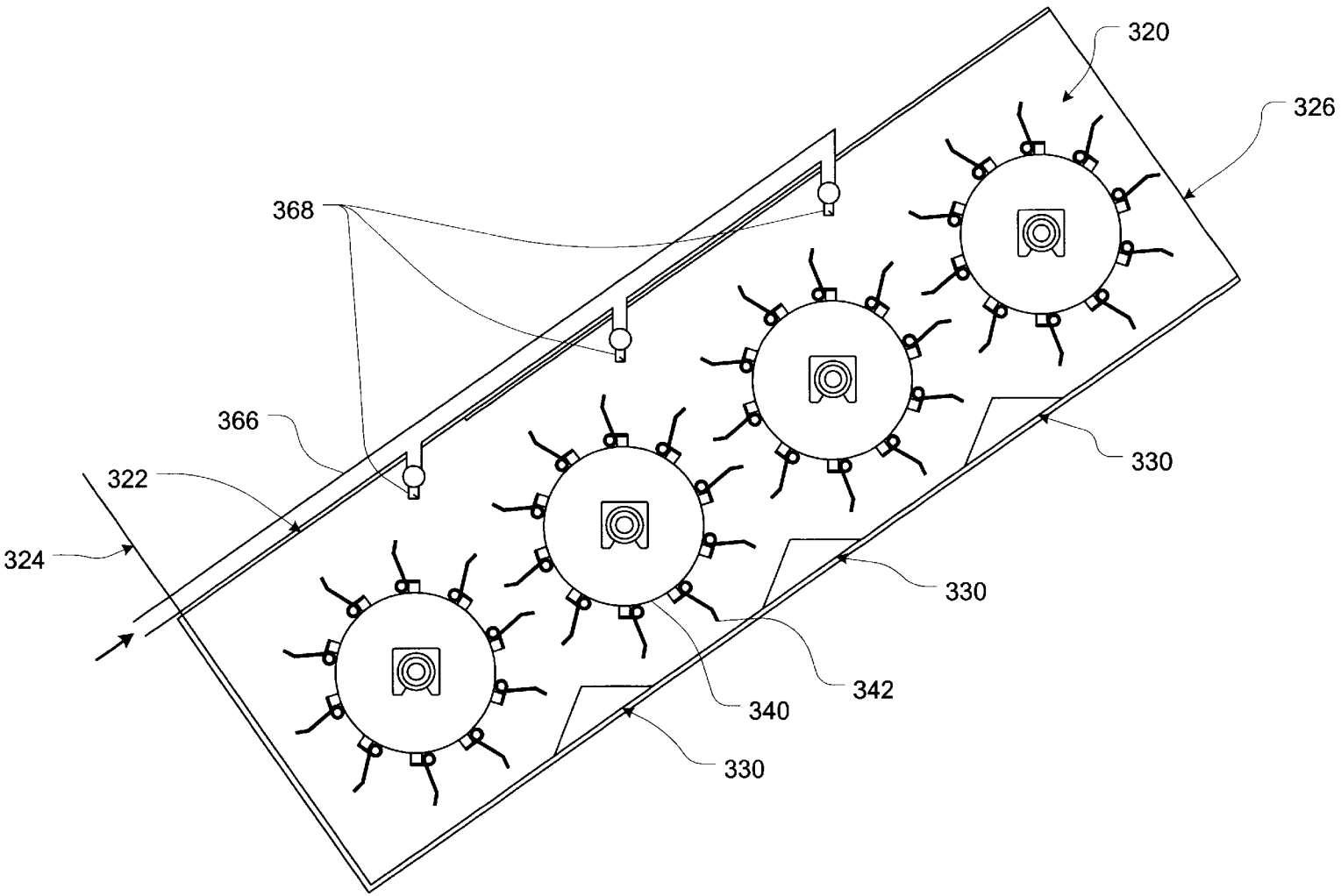
FIG. 3 shows a functional block diagram outlining a second exemplary embodiment of a liquid additive/materials mixing chamber according to this invention.

FIG. 3 shows a functional block diagram outlining a second exemplary embodiment of a liquid additive/materials mixing chamber according to this invention. As shown in FIG. 3, the mixing chamber 320 includes a mixing chamber input opening 322, a mixing chamber backwall extension 324, a mixing chamber discharge opening 326, and tined cylinders 340. A liquid additive is sprayed into the mixing chamber 330, via additive supply line 366, and spray nozzles 368. These elements correspond to and operate similarly to the same elements discussed above with respect to FIGS. 1 and 2.

However, the mixing chamber 320 also includes elements 330. As shown in FIG. 3, elements 330 serve to stall the progress of the wood chips through the mixing chamber 320 so as to ensure that each of the wood chips is saturated to a desired level by the liquid additive. It should be appreciated that any number of elements 330 may be introduced into the mixing chamber 320 and that the elements 330 may vary in shape depending on the desired rate of travel of the wood chips through the mixing chamber 330.

FIG. 4 shows a side view of an exemplary embodiment of the tined cylinder 140 according to this invention. As shown in FIG. 4, the tined cylinder 140 comprises at least one cylindrical disk 141. A plurality of tine supports 148 are disposed along an outer circumference of the at least one cylindrical disk 141. Multiple tines 142 are then either removably or permanently attached to each of the tine supports 148.

FIG. 5 shows a perspective view of a first exemplary embodiment of a tined cylinder 540 according to this invention. It should be appreciated that, in various exemplary embodiments of this invention, the tined cylinder 540 is the tined cylinder 140, as shown in FIGS. 1–4, and similarly numbered elements correspond to and operate similarly to the same elements discussed above with respect to FIGS. 1–4.

As shown in FIG. 5, the tined cylinder 540 comprises a cylindrical disk 541. A plurality of tine supports 548 are permanently or removably disposed along an outer circumference of the cylindrical disk 541. Multiple tines 542 are then permanently or removably attached to each of the tine supports 548.

In various exemplary embodiments, each tine 542 is constructed of spring steel wire. Each tine 542 extends from a tine support 548 and bends, to form an end portion 546. The tine end portion 546 allows each tine to efficiently agitate, mix, and tumble wood chips within the mixing chamber.

In various exemplary embodiments, each tine 542 includes two end portions 546. However, it should be appreciated that each tine may include only one end portion 546 extending from a tine support 548.

Each tine 542 also includes a tine biasing portion 544. In various exemplary embodiments, the tine biasing portion 544 is a circular bend in the tine 542 that allows the tine 542 to flex a predetermined amount in order to allow the wood chips to be swept through the mixing chamber without being broken.

It should be appreciated that, although FIG. 5 shows the tined cylinder 540 having the tine supports 548 extending beyond the cylindrical disk 541, in various exemplary embodiments, the tine supports 548 do not extend beyond the cylindrical disk 541. Furthermore, in various exemplary embodiments, the cylindrical disk 541 extends beyond the tine supports 548.

Additionally, it should be understood that although the tines 542 are only shown on two of the tine supports 548, tines 542 are included on each tine support 548.

FIG. 6 shows a perspective view of a second exemplary embodiment of a tined cylinder 640 according to this invention. It should be appreciated that, in various exemplary embodiments of this invention, the tined cylinder 640 is the tined cylinder 140, as shown in FIGS. 1–4, and similarly numbered elements correspond to and operate similarly to the same elements discussed above with respect to FIGS. 1–4.

As shown in FIG. 6, the tined cylinder 640 comprises multiple tines 642 (each having an end portion 646 and a tine biasing portion 644) and a plurality of tine supports 648. These elements listed above correspond to and operate similarly to the same elements discussed above with respect to FIG. 5.

However, the tined cylinder 640 further comprises at least two cylindrical disks 641 disposed along a common rotational access. The at least two cylindrical disks 641 correspond to and replace the cylindrical disk 541, of FIG. 5.

It should be appreciated that, in various exemplary embodiments, the tined cylinder 640 comprises more than two cylindrical disks 641 disposed along a common rotational access. It should also be appreciated that, although FIG. 6 shows the tined cylinder 640 having the tine supports 648 extending beyond the cylindrical disks 641, in various exemplary embodiments, the tine supports 648 do not extend beyond the cylindrical disks 641. Furthermore, in various exemplary embodiments, the cylindrical disks 641 extend beyond the tine supports 648.

Additionally, it should be understood that although the tines 642 are only shown on two of the tine supports 648, tines 642 are included on each tine support 648.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A mixing chamber for applying a liquid additive to a material, comprising:

a chamber having an input opening and an discharge opening, wherein the material to which the liquid additive is to be applied is supplied to the chamber, via the input opening of the chamber;

a number of rotatable cylinders, wherein each rotatable cylinder includes a plurality of tines extending from the cylinder, wherein each of the tines is removably or permanently affixed to at least one tine support, wherein each tine support is removably or permanently affixed to a rotatable cylinder, and wherein the rotatable cylinders are disposed within the chamber, between the input opening and the discharge opening, such that, when each cylinder is rotated, the plurality of tines move the material from the input opening, through the chamber, to the discharge opening;

at least one spray nozzle, positioned within the chamber, wherein the at least one spray nozzle is positioned such that the at least one spray nozzle can introduce a controlled amount of liquid additive into the chamber;

a liquid additive supply reservoir for holding an amount of the liquid additive; and a pump connecting the liquid additive supply reservoir to the at least one spray nozzle, via an additive supply line, for supplying the liquid additive to the at least one spray nozzle;

wherein the rate at which the material is moved through the chamber and the amount of liquid additive introduced into the chamber are independently controllable such that the amount of liquid additive that the material is exposed to is controllable.

2. The apparatus of claim 1, wherein the liquid additive comprises at least one of a chemical, colorant, die, and/or paint.

3. The apparatus of claim 1, wherein the liquid additive comprises at least one of a chemical, colorant, die, and/or paint in an aqueous solution.

4. The apparatus of claim 1, wherein the material comprises at least one of wood, rubber, plastic, and/or composite materials that have been reduced to appropriately sized particles.

5. The apparatus of claim 1, wherein the chamber is arranged at an upwardly inclined angle.

6. The apparatus of claim 1, wherein the chamber is arranged such that the mixing chamber is substantially horizontal.

7. The apparatus of claim 1, wherein each rotatable cylinder comprises two cylindrical discs disposed along a common rotational axis.

8. The apparatus of claim 1, wherein all of the rotatable cylinders rotate at the same rotational velocity.

9. The apparatus of claim 1, wherein at least one of the rotatable cylinders rotates at a rotational velocity that is different from the rotational velocity of at least one other rotatable cylinder.

10. The apparatus of claim 1, wherein each of the plurality of tines comprises spring steel.

11. The apparatus of claim 1, wherein each of the plurality of tines is spring biased.

12. The apparatus of claim 1, wherein a plurality of tine supports are removably or permanently affixed to an outer surface of the rotatable cylinder.

13. The apparatus of claim 1, wherein the at least one spray nozzle is repositionable within the chamber.

14. The apparatus of claim 1, further including a volume regulator for controlling the volume and/or pressure at which the liquid additive is supplied to the at least one spray nozzle.

15. A system for applying a liquid additive to a material, comprising:

a mixing chamber having an input opening and an discharge opening, wherein the material to which the liquid additive is to be applied is supplied to the mixing chamber, via the input opening of the mixing chamber;

a number of rotatable cylinders disposed within the mixing chamber, between the input opening and the discharge opening, wherein each rotatable cylinder includes a plurality of tines extending from the cylinder, such that, when each cylinder is rotated, the plurality of tines move the material from the input opening, through the mixing chamber, to the discharge opening;

at least one spray nozzle, positioned within the mixing chamber, wherein the at least one spray nozzle is positioned such that the at least one spray nozzle can introduce a controlled amount of liquid additive into the mixing chamber;

a liquid additive supply reservoir for holding an amount of the liquid additive;

a pump connecting the liquid additive supply reservoir to the at least one spray nozzle, via an additive supply line, for supplying the liquid additive to the at least one spray nozzle;

wherein the rate at which the material is moved through the mixing chamber and the amount of liquid additive introduced into the mixing chamber are independently controllable such that the amount of liquid additive that the material is exposed to is controllable; and a supply hopper having an input opening and an discharge opening for supplying a uniform flow of the material to the mixing chamber, wherein the supply hopper includes an adjustable flow control gate positioned at the discharge opening of the supply hopper.

16. The system of claim 15, further comprising a discharge conveyor, wherein the discharge conveyor is positioned adjacent or below the mixing chamber discharge opening such that the material being discharged from the mixing chamber can be transported to a specific location.

17. The system of claim 15, wherein the mixing chamber is arranged at an upwardly inclined angle.

18. The system of claim 15, wherein the mixing chamber is arranged such that the mixing chamber is substantially horizontal.

19. The system of claim 15, wherein all of the rotatable cylinders rotate at the same rotational velocity.

20. The system of claim 15, wherein at least one of the rotatable cylinders rotates at a rotational velocity that is different from the rotational velocity of at least one other rotatable cylinder.

21. The system of claim 15, wherein each of the plurality of tines comprises spring steel.

22. The system of claim 15, wherein each of the plurality of tines is spring biased.

23. The system of claim 15, further including a volume regulator for controlling the volume and/or pressure at which the liquid additive is supplied to the at least one spray nozzle.

24. A method for applying a liquid additive to a material, comprising the steps of:

receiving the material to which the liquid additive is to be applied within a chamber including an input opening and an discharge opening, wherein the material is supplied to the input opening of the chamber, wherein the chamber also includes a number of rotatable cylinders, wherein each rotatable cylinder includes a plurality of tines extending from the cylinder, wherein each of the tines is removably or permanently affixed to at least one tine support, wherein each tine support is removably or permanently affixed to a rotatable cylinder, and wherein the rotatable cylinders are disposed within the chamber, between the input opening and the discharge opening, such that, when each cylinder is rotated, the plurality of tines move the material from the input opening, through the chamber, to the discharge opening;

introducing a controlled amount of liquid additive into the chamber;

rotating the rotatable cylinders, via at least one motor, to intermix the material and the liquid additive within the chamber and convey the material toward the discharge opening, such that the rate at which the material is conveyed through the chamber and the amount of liquid additive introduced into the chamber are independently controllable such that the amount of liquid additive that the material is exposed to is controlled; and discharging the material to which the liquid additive has been applied through the discharge opening.

25. The apparatus of claim 24, wherein the liquid additive comprises at least one of a chemical, colorant, die, and/or paint.

26. The apparatus of claim 24, wherein the liquid additive comprises at least one of a chemical, colorant, die, and/or paint in an aqueous solution.

27. The apparatus of claim 24, wherein the material comprises at least one of wood, rubber, plastic, and/or composite materials that have been reduced to appropriately sized particles.

28. The method of claim 24, wherein the chamber is arranged at an upwardly inclined angle.

29. The method of claim 24, wherein the chamber is arranged such that the mixing chamber is substantially horizontal.

30. The method of claim 24, wherein the step of rotating the rotatable cylinders includes rotating all of the rotatable cylinders at the same rotational velocity.

31. The method of claim 24, wherein the step of rotating the rotatable cylinders includes rotating at least one of the rotatable cylinders at a rotational velocity that is different from the rotational velocity of at least one other rotatable cylinder.

32. The method of claim 24, wherein each of the plurality of tines comprises spring steel.

33. The method of claim 24, wherein each of the plurality of tines is spring biased.

34. The method of claim 24, wherein the step of introducing a controlled amount of liquid additive into the chamber includes introducing the controlled amount of liquid additive into the chamber via at least one spray nozzle.

35. The method of claim 24, wherein the at least one spray nozzle is repositionably affixed within the chamber.

36. The method of claim 24, further including the step of controlling the volume and/or pressure at which the liquid additive is introduced into the chamber.

37. The method of claim 24, further including the step of supplying the material to the input opening of the chamber via a supply hopper having an input opening and an discharge opening, wherein the supply hopper supplies a uniform flow of the material to the chamber.

38. The method of claim 24, further including the step of positioning a discharge conveyor adjacent or below the mixing chamber discharge opening such that the material being discharged from the mixing chamber is transported to a specific location.

39. A mixing chamber for applying a liquid additive to a material, comprising:

a chamber having an input opening and an discharge opening, wherein the material to which the liquid additive is to be applied is supplied to the chamber, via the input opening of the chamber;

a number of rotatable cylinders, wherein each rotatable cylinder includes a plurality of spring biased tines extending from the cylinder, and wherein the rotatable cylinders are disposed within the chamber, between the input opening and the discharge opening, such that, when each cylinder is rotated, the plurality of tines move the material from the input opening, through the chamber, to the discharge opening;

at least one spray nozzle, positioned within the chamber, wherein the at least one spray nozzle is positioned such that the at least one spray nozzle can introduce a controlled amount of liquid additive into the chamber;

a liquid additive supply reservoir for holding an amount of the liquid additive; and a pump connecting the liquid additive supply reservoir to the at least one spray nozzle, via an additive supply line, for supplying the liquid additive to the at least one spray nozzle;

wherein the rate at which the material is moved through the chamber and the amount of liquid additive introduced into the chamber are independently controllable such that the amount of liquid additive that the material is exposed to is controllable.

40. The apparatus of claim 39, wherein each of the plurality of tines is removably or permanently affixed to the rotatable cylinder.

41. The apparatus of claim 39, wherein each of the plurality of tines is removably or permanently affixed to an outer surface of the rotatable cylinder.

42. The apparatus of claim 39, wherein each of the plurality of tines is removably or permanently affixed to a tine support, and wherein each tine support is removably or permanently affixed to the rotatable cylinder.

* * * * *